US008936079B2

(12) United States Patent
Cherewyk

(10) Patent No.: US 8,936,079 B2
(45) **Date of Patent: *Jan. 20, 2015**

(54) SYSTEM, APPARATUS AND PROCESS FOR COLLECTING BALLS FROM WELLBORE FLUIDS CONTAINING SAND

(71) Applicant: Isolation Equipment Services, Inc., Red Deer (CA)

(72) Inventor: Boris (Bruce) P. Cherewyk, Calgary (CA)

(73) Assignee: Isolation Equipment Services Inc., Red Deer (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,714

(22) Filed: Jul. 11, 2013

(65) Prior Publication Data

US 2013/0292113 A1 Nov. 7, 2013

Related U.S. Application Data

(60) Division of application No. 13/848,848, filed on Mar. 22, 2013, which is a division of application No. 12/815,352, filed on Jun. 14, 2010, now Pat. No. 8,434,549, which is a continuation-in-part of application No. 12/144,401, filed on Jun. 23, 2008, now Pat. No. 7,735,548.

(60) Provisional application No. 61/345,938, filed on May 18, 2010, provisional application No. 60/945,989, filed on Jun. 25, 2007.

(51) Int. Cl.

| | |
|---|---|
| ***E21B 43/34*** | (2006.01) |
| ***E21B 33/068*** | (2006.01) |
| ***E21B 34/14*** | (2006.01) |
| ***E21B 43/14*** | (2006.01) |
| ***E21B 43/26*** | (2006.01) |

(52) U.S. Cl.

CPC ..... *E21B 33/068* (2013.01); *E21B 34/14* (2013.01); *E21B 43/14* (2013.01); *E21B 43/26* (2013.01)

USPC ..... 166/267; 166/91.1

(58) Field of Classification Search

USPC ..... 166/267, 91.1, 75.15; 137/268

See application file for complete search history.

(56) References Cited

U.S. PATENT DOCUMENTS

| | | | | |
|---|---|---|---|---|
| 3,983,594 | A * | 10/1976 | Simonelli | 15/104.062 |
| 4,016,621 | A * | 4/1977 | Slegers et al. | 15/104.062 |
| 4,073,303 | A * | 2/1978 | Foley, Jr. | 137/15.07 |
| 4,102,401 | A * | 7/1978 | Erbstoesser | 166/284 |
| 4,106,562 | A * | 8/1978 | Barnes et al. | 166/75.12 |
| 8,434,549 | B2 * | 5/2013 | Cherewyk | 166/91.1 |

* cited by examiner

*Primary Examiner* — Catherine Loikith

(74) *Attorney, Agent, or Firm* — Sean W Goodwin

(57) ABSTRACT

A ball catcher for recovering balls from wellbore fluids containing sand during flow back operations. The ball catcher has a receiving chamber for receiving the wellbore fluids containing sand, a first flow outlet for discharging a portion of the wellbore fluids and sand contained therein, and a diverter for redirecting balls entrained within the wellbore fluids. The redirected balls and a balance of the wellbore fluids also containing sand are received in a ball-retaining chamber. A blocker fit to the ball-retaining chamber retains the recovered balls therein while the balance of the wellbore fluids and sand contained therein is discharged from a second flow outlet and directed to downstream equipment through an auxiliary flow line. The retaining chamber can be isolated allowing the balls to be removed from the ball catcher without disrupting the flow back operation.

13 Claims, 14 Drawing Sheets

SYSTEM, APPARATUS AND PROCESS FOR COLLECTING BALLS FROM WELLBORE FLUIDS CONTAINING SAND

CROSS-REFERENCE TO RELATED APPLICATIONS

This application claims the benefits under 35 U.S.C. 120 of the U.S. patent application Ser. No. 13/848,848, filed on Mar. 22, 2013, which is a divisional of U.S. patent application Ser. No. 12/815,352, filed on Jun. 14, 2010, which issued as U.S. Pat. No. 8,434,549 on May 7, 2013 and benefits under 35 U.S.C. 119(e) of U.S. Provisional Application 61/345,938 filed on May 18, 2010, and is also a continuation-in-part application of U.S. patent application Ser. No. 12/144,401, filed Jun. 23, 2008, which issued as U.S. Pat. Ser. No. 7,735,548 on Jun. 15, 2010; and the benefits under 35 U.S.C. 119(e) of U.S. Provisional Application 60/945,989 filed on Jun. 25, 2007, which are all incorporated fully herein by reference.

FIELD OF THE INVENTION

This invention relates generally to apparatus and process for the retrieval of balls from a wellbore, such as drop balls, frac balls, packer balls and other balls for interacting with downhole tools in the wellbore. The balls are recovered from a wellbore fluid stream containing sand therein, which flows from the wellbore, such as after stimulation operations. More particularly, the apparatus and process uses apparatus affixed to the wellhead for receiving wellbore fluids containing sand therein and having balls, discharging a portion of the wellbore fluids and sand contained therein through a first flow outlet, redirecting or diverting the balls to a retaining chamber, and blocking the balls from discharging from the retaining chamber while permitting the wellbore fluids and sand contained therein to discharge from the ball catcher and be directed to downstream equipment for treatment.

BACKGROUND OF THE INVENTION

It is known to conduct fracturing or other treating procedures in a wellbore by isolating zones in the wellbore using packers and the like and subjecting the isolated zone to treatment fluids at treatment pressures. In a typical fracturing procedure, for example, the casing of the well is perforated to admit oil and/or gas from the formation into the well and fracturing fluid is then pumped into the well and through these perforations into the formation. Such treatment opens and/or enlarges draining channels in the formation, enhancing the producing ability of the well. Alternatively, the completion can be an open hole type that is completed without casing in the producing formation area.

It is desired to stimulate multiple zones, or intervals within the same zone, using onsite stimulation fluid pumping equipment (pumpers). A packer arrangement is inserted at intervals isolating one zone from an adjacent zone. It is known to introduce a drop ball through the wellbore to engage one of the packers (or packer interval) in order to block fluid flow therethrough. Passage through a downhole packer is thereby plugged off with this drop ball that is pumped into the wellbore during the stimulation flush. The drop ball blocks off this downhole packer, isolating the wellbore uphole of the downhole packer and consequently a second zone, above this downhole packer, can be stimulated. Once stimulated, a subsequent drop ball can be dropped to block off a subsequent packer uphole of the blocked packer for stimulation thereabove. This continues until all the desired zones are stimulated.

At surface, the wellbore is generally furnished with a frac-head unit including a multi-port block or a Y-type frac header, isolation tool or the like, which provides fluid connections for introducing stimulation fluids including sand, gels and acid treatments.

After well operations, fluid from the well is flowed to surface through the wellhead or frachead. The fluid is urged from the well such as under formation pressures and/or the influence of a gaseous charge of $CO_2$ or $N_2$. The fluid from the well exits the wellhead from a horizontally extending fitting. To separate the balls from the fluid, it is known to use a cross fitting apparatus such as a plate extending across the flow path from the wellhead. The plate is typically a plate across the flow path having large slots or screen at the face such as an upside down "U" or fork shape for impeding balls recovered with the fluid while permitting fluid to flow therethrough the "U" shape.

It is known for balls, of which various sizes are employed in one well operation, to become lodged at the prior art U-shape or screen and block fluid flow. In other instances, the balls can break apart which encourages further blockages.

During maximum flow back operations involving wellbore fluids containing sand, stagnation of the wellbore fluids in the ball catcher and related apparatus can cause the sand entrained therein to settle and rapidly accumulate, interfering with ball catcher performance. Failure of the ball catcher can result in wellbore plugging and other complications.

Therefore, there is a need for a more effective apparatus for retrieving balls from wellbore fluids containing sand after a well operation.

SUMMARY OF THE INVENTION

Embodiments of the present invention intercept and divert balls returning with wellbore fluid into a ball-recovery reservoir. A ball catcher body includes a replaceable diverter which separates balls and debris from the fluid flow. In embodiments, a sand-tolerant ball-retaining system continually removes produced sand for avoiding sand accumulation in the ball catcher and associated apparatus, resulting in improved, reliable ball catcher operations.

In one aspect of the invention, apparatus is provided for retrieving oversize debris and balls carried with a fluid flow from a wellhead port. A catcher body is adapted to be fluidly connected to the wellhead port and has a flow outlet. A diverter is fit to the catcher body and has a wellhead end positioned to intercept the fluid flow from the wellhead port so as to divert debris and balls carried therein into a ball-recovery chamber. The diverter has a wellhead end has flow passages formed therethrough for receiving the fluid flow free of debris and balls. The diverter has a bore in fluid communication with the flow outlet. Fluid flow through the flow passages enters the bore for discharge from the catcher body.

In another aspect of the invention, a catcher body is connected and positioned along a fluid flow path from the wellhead. The catcher body has a first flow path contiguous with fluid flow from the wellhead and an intersecting stagnant ball-recovery reservoir. The catcher body has a catcher flow outlet for fluid free of debris and balls. The debris and balls have a first velocity vector along the flow path towards the catcher flow outlet. A diverter, fit to the catcher body and having a wellhead end extending into the flow path intercepts the fluid flow. The diverter has a bore being open at a tail end and in fluid communication with the catcher flow outlet. The diverter has a diverter face at the wellhead end and being positioned inline with the first velocity vector for intercepting and substantially arresting the debris and balls and for diverting the debris and balls along into the ball-recovery reservoir. An annular chamber formed in the discharge outlet about the wellhead end of the diverter receives the fluid flow. A plurality of flow passages extending through the wellhead end of the diverter conduct fluid flow, free of debris and balls, from the annular chamber to the bore for discharge through the tail end.

In another aspect of the invention, a ball catcher and sand-tolerant ball-retaining system is provided for recovering at balls carried in wellbore fluids having sand. A receiving chamber is fluidly connected to the wellbore for receiving the wellbore fluids containing sand. The receiving chamber has a first flow outlet for discharging a portion of the wellbore fluids and sand contained therein to downstream equipment and a ball outlet for discharging a balance of the wellbore fluids also containing sand. A diverter, fit to the receiving chamber, redirects the balls to the ball outlet. A ball-retaining chamber, fluidly connected below the ball outlet, receives the redirected balls and the balance of the wellbore fluids. The ball catcher further has a blocker fit to a second flow outlet from the ball-retaining chamber for retaining the balls within the ball-retaining chamber while permitting the discharge of the balance of the wellbore fluids and sand contained therein, free of the balls, to the downstream equipment.

In another aspect of the invention, a sand-tolerant ball-retaining system can be positioned between a ball-recovery chamber and an isolation valve below a ball catcher to enable continual flow of wellbore fluid while safely recovering collected balls from the ball-recovery chamber.

In another aspect, a system for a ball catcher is disclosed which redirects balls carried in wellbore fluids having a sand content to a ball-recovery chamber and passes a portion of the wellbore fluids free of the balls to downstream equipment. The system has a ball-retaining chamber fluidly connected below the ball catcher for receiving the balls and a balance of the wellbore fluids and sand contained therein. The ball-retaining chamber has an outlet fit with a blocker for retaining the within the ball-retaining chamber while discharging and directing the balance of the wellbore fluids and sand contained therein, through an auxiliary flow line to downstream equipment.

Yet in another aspect of the invention, a process for recovering balls carried in wellbore fluids containing sand is disclosed. The process involves receiving the wellbore fluids containing sand in a receiving chamber; discharging a portion of the wellbore fluids and sand contained therein, free of the balls, through a flow outlet while discharging a balance of the wellbore fluids and sand contained therein to a ball-retaining chamber, redirecting the at least balls to the ball-retaining chamber, blocking the at least balls within the ball-retaining chamber from discharging therefrom, and discharging the portion of the wellbore fluids and sand contained therein, free of the balls, from the ball-retaining chamber.

As a result, a reliable and easy to clean sand-tolerant ball catcher is provided for servicing wells after stimulation and cleaning operations.

BRIEF DESCRIPTION OF THE DRAWINGS

FIG. 9 is schematic representation of an embodiment of the present invention illustrating the flow of wellbore fluids through a ball catcher having a ball receiving chamber, a first flow outlet, a ball outlet, a ball-retaining chamber, and an auxiliary flow line;

FIG. 10 is a schematic representation of an embodiment of the present invention illustrating a ball catcher having a ball receiving chamber, a first flow outlet, a ball outlet, a diverter, a ball-retaining chamber, a blocker and an auxiliary flow line;

FIG. 12 is a schematic representation of an embodiment of the present invention illustrating a blocker having a chamber end shaped to prevent recovered balls from blocking a fluid passageway and the plurality of radial passageways from fluidly communicating wellbore fluids;

FIG. 13 is a schematic representation of an embodiment of the present invention illustrating a ball-recovery chamber fluidly connected to the bottom of a ball-retaining chamber;

DETAILED DESCRIPTION OF THE PREFERRED EMBODIMENTS

Figure 1:
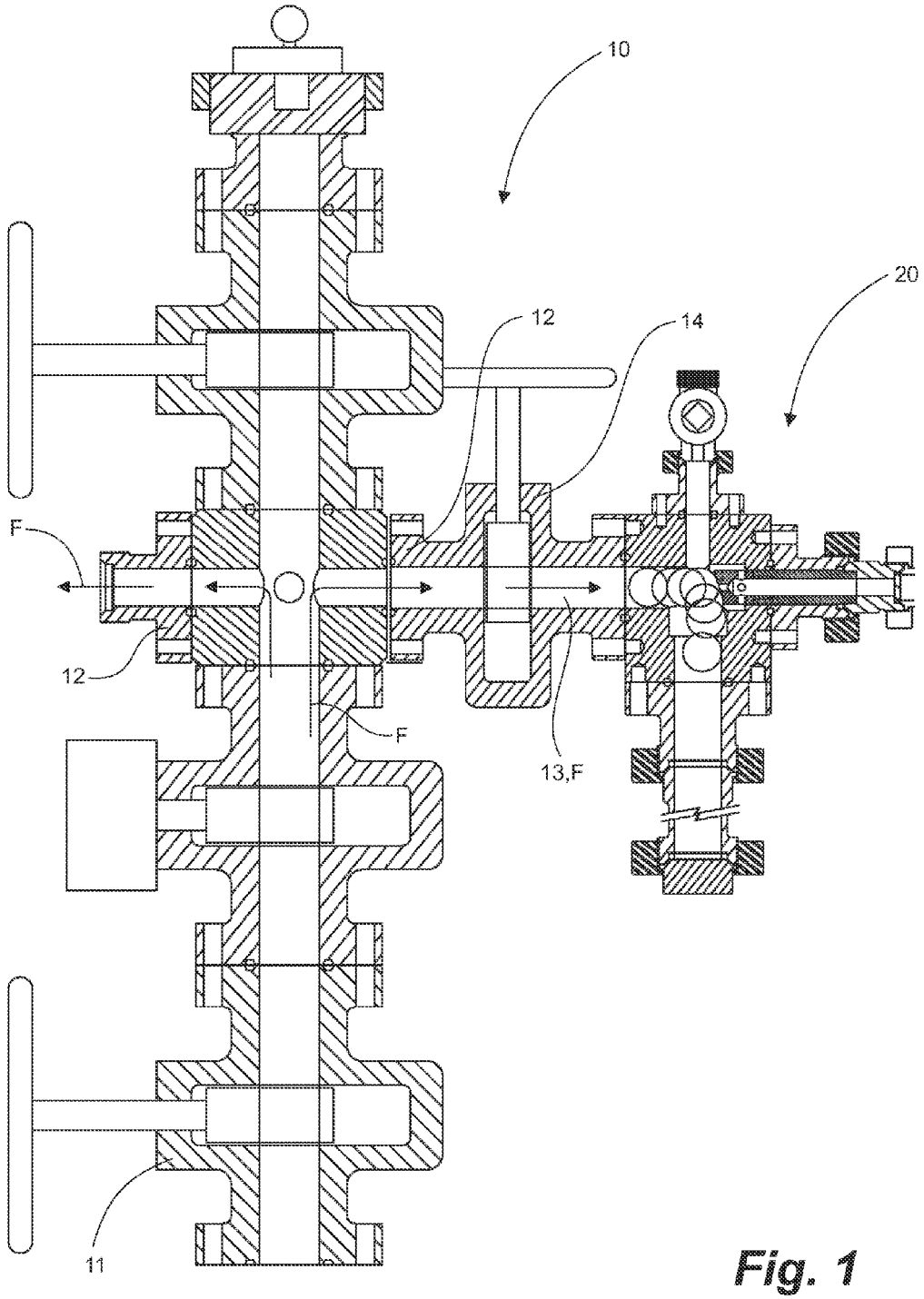
FIG. 1 is a cross-sectional view of a wellhead of conventional configuration fit with a flow port such as a frachead and a ball catcher according to one embodiment of the invention.

With reference to FIG. 1, in the context of fracturing a formation traversed by a wellbore and recovering fluid therefrom, a wellhead 10 is connected to the wellbore (not shown) for introducing fracturing fluid and drop balls for various operations to the wellbore. The wellhead comprises a shutoff valve 11 and a flow port 12 thereabove, typically integrated with a frachead. Thereafter a fluid flow F carrying debris and drop balls B are flowed out of the well through the flow port along a fluid path 13. While a variety of materials such as frac sand are carried out of the wellbore with the fluid flow, for the purposes of simplicity herein, this application discusses the apparatus and operations in the context of the recovery of balls.

Figure 2:
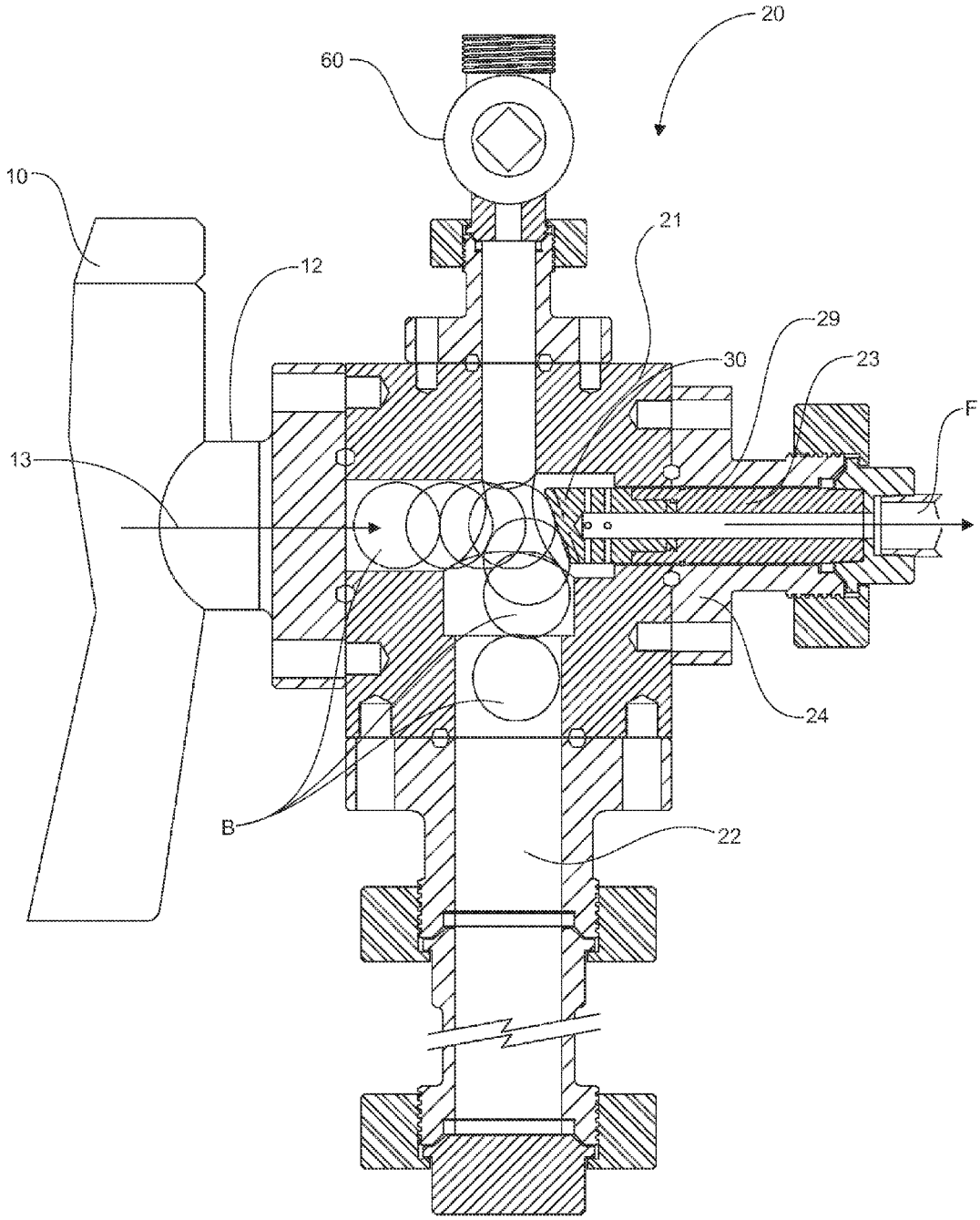
FIG. 2 is a cross section of a ball catcher body according to one embodiment of the invention fit to a flow port of a wellhead illustrating the sequential movement of a ball carried out of a wellbore with fluid flow to divert for recovery in the ball-recovery reservoir.

With reference to FIG. 2, an embodiment of a ball catcher 20 is adapted to be connected to the wellhead's flow port 12, such as through an isolation valve 14, for catching drop balls B before they travel downstream and adversely affect other equipment.

As shown, the ball catcher 20 comprises a catcher body 21 fit to the wellhead 10 or isolation valve 14 at a wellhead connection using industry approved threaded or flanged connections. The catcher body 21 further comprises a stagnant reservoir or ball-recovery chamber 22 which intersects the fluid path 13. Fluid flow F flows along a first velocity vector or fluid path 13 and is interrupted with a diverter 23 fit to a catcher flow outlet 24. The fluid flow F carries the balls to impact the diverter, separating fluid flow F and the balls B for discharge of the fluid flow from the catcher flow outlet 24 and recovery of the balls at the ball-recovery chamber 22.

Figure 3A:
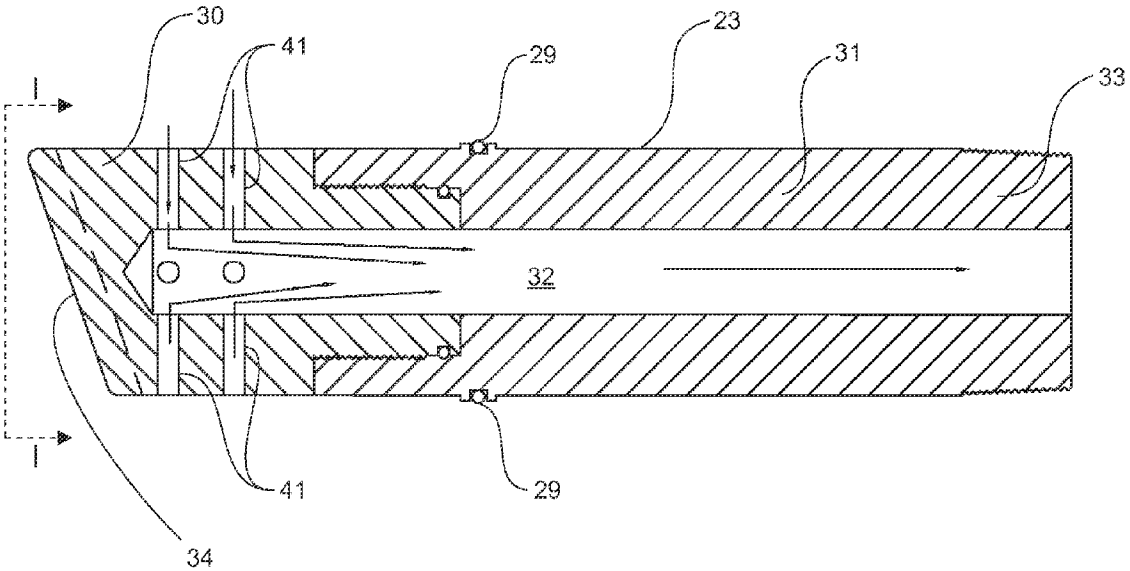
FIGS. 3A is a side cross-sectional view of an embodiment of a ball diverter.
Figure 3B:
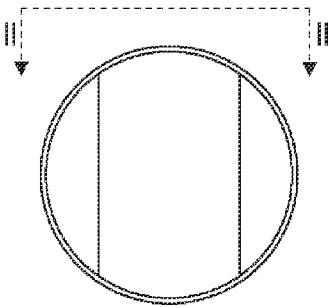
FIGS. 3B and 3C are face and partial top views of the diverter of FIG. 3A along lines B-B and C-C respectively.
Figure 3C:
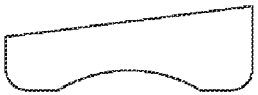

With reference also to FIGS. 3A-3C, the diverter 23 has a wellhead end 30 for intercepting the fluid flow F and a diverter body 31 fluidly sealed, such as by an O-ring 29, to the catcher flow outlet 24. The diverter body 31 has bore 32 and a fluid discharge or tail end 33. The bore 32 is open at the tail end 33 and in fluid communication with the catcher flow outlet 24 for the collection and discharge of fluid flow F liberated of oversize solids such as the balls B. The wellhead end 30 of the diverter 23 projects into the fluid path 13 and comprises a diverter face 34 positioned in the fluid path 13. The diverter face 34 is positioned inline with the first velocity vector for intercepting and substantially arresting the debris and balls B and for diverting the debris and balls along into the ball-recovery chamber 22.

Referring also to FIG. 2, kinetic energy in balls B is dissipated at the diverter face 34 and the balls fall under gravity into the ball-recovery chamber 22. The ball-recovery chamber 22 is intersects and fluidly contiguous with, but diverges from, the flow path 13. As shown, the flow path can be substantially horizontal from the wellhead 10 and ball-recovery chamber 22 is positioned below the diverter face 34. The diverter face 34 can be angled downward, from top to bottom and away from the fluid path 13, for directing, deflecting or urging the balls downward into the ball-recovery chamber 22. A cross-sectional dimension of the diverter face 34 can be substantially the diameter of that of the flow path 13. Best seen in FIG. 3, the diverter face 34 can have a concave face having an axis oriented generally downwards towards the ball-recovery chamber 22.

Figure 4:
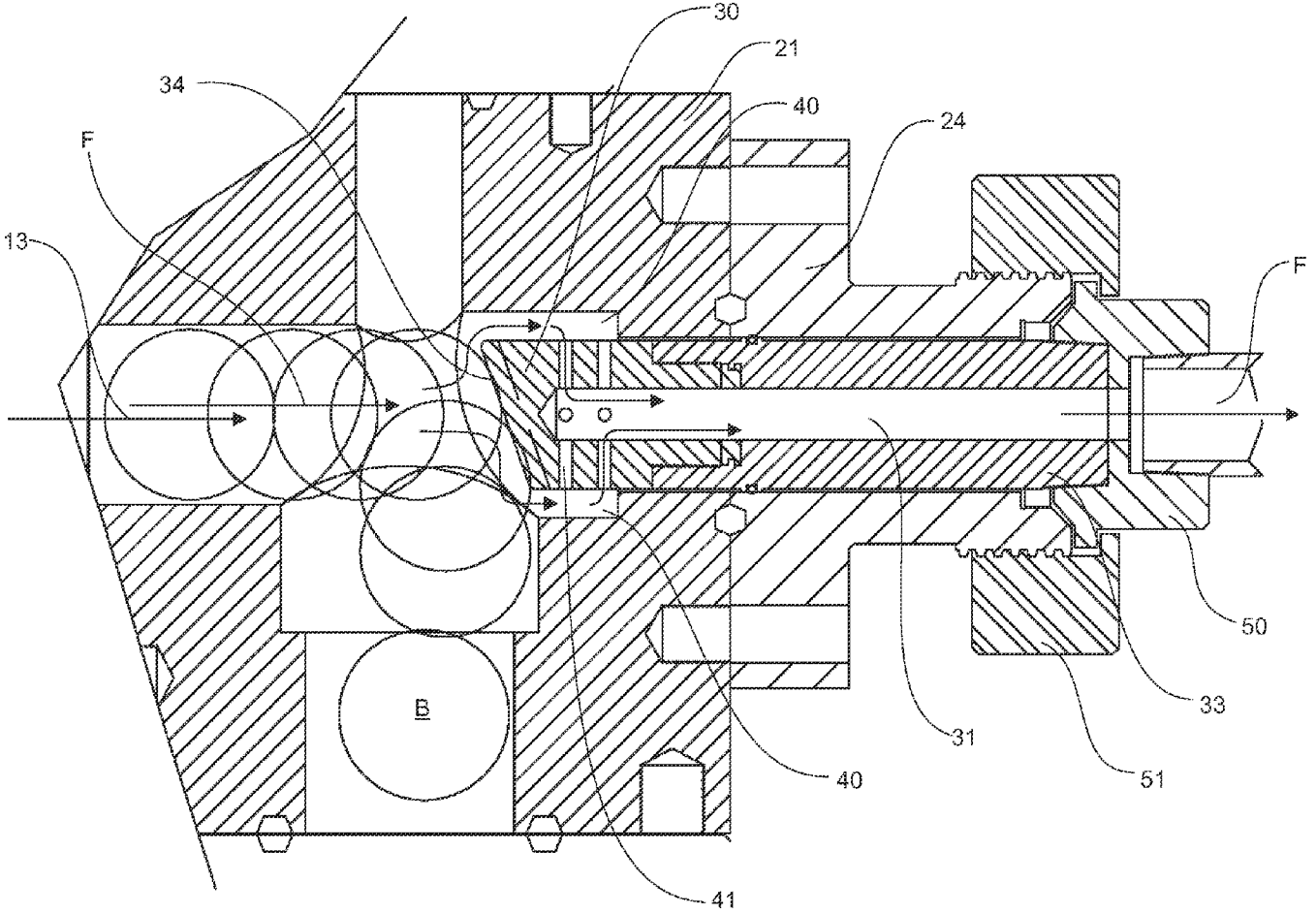
FIG. 4 is a partial cross-sectional close up view of the diverter of FIG. 4 installed in the ball catcher body.

With reference to FIG. 4, the diverter face 34 diverts oversize solids, such as debris or balls B.

In one embodiment, the diverter face 34 diverts a portion or all of the fluid flow F therearound. An annular chamber 40 is formed in the catcher body 21 or catcher flow outlet 24 about the wellhead end 30 of the diverter 23. The annular chamber 40 receives fluid flow F continuing to flow substantially along the flow path 13 and about the diverter face 34. The fluid flow F flows through the annular chamber 40 and inward through flow passages 41 formed or extending through the wellhead end 30. The bore 32 receives fluid flow F free of debris and balls for discharging the fluid flow from the catcher body.

Figure 5A:
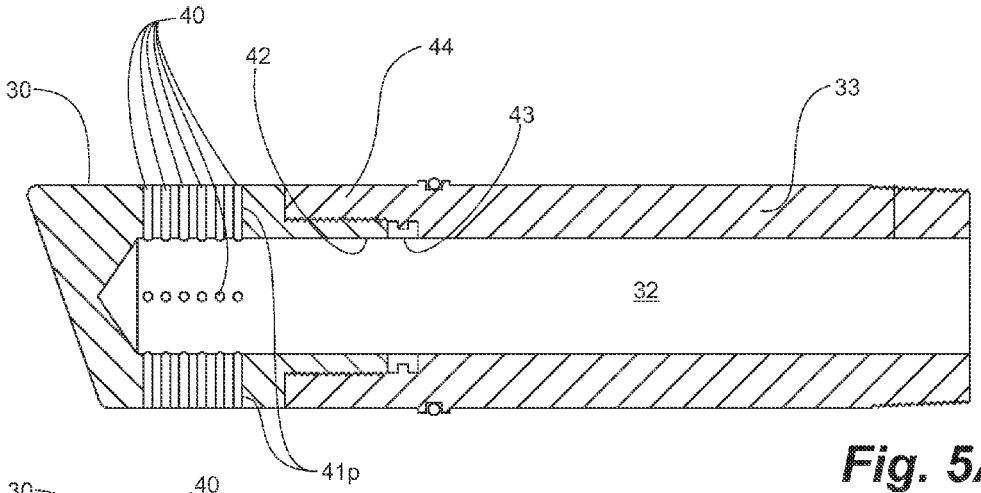
FIGS. 5A, 5B, 5C, 5D and 5E are cross-sectional views of various embodiments of a diverter.
Figure 5B:
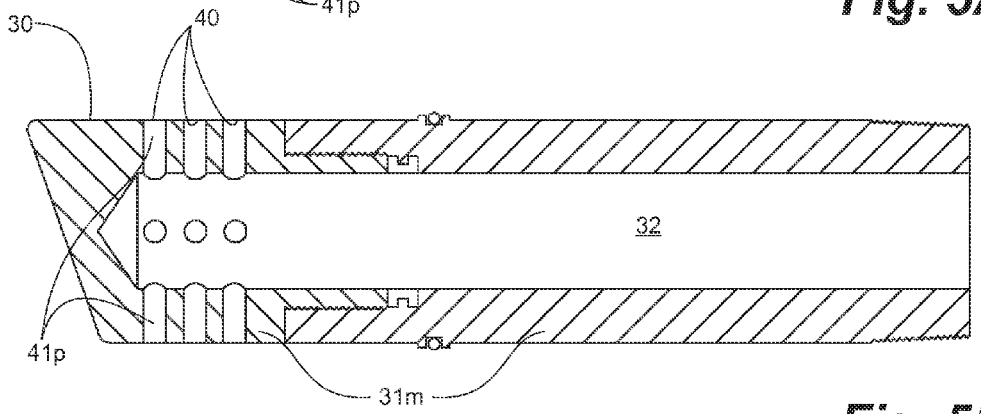
Figure 5C:
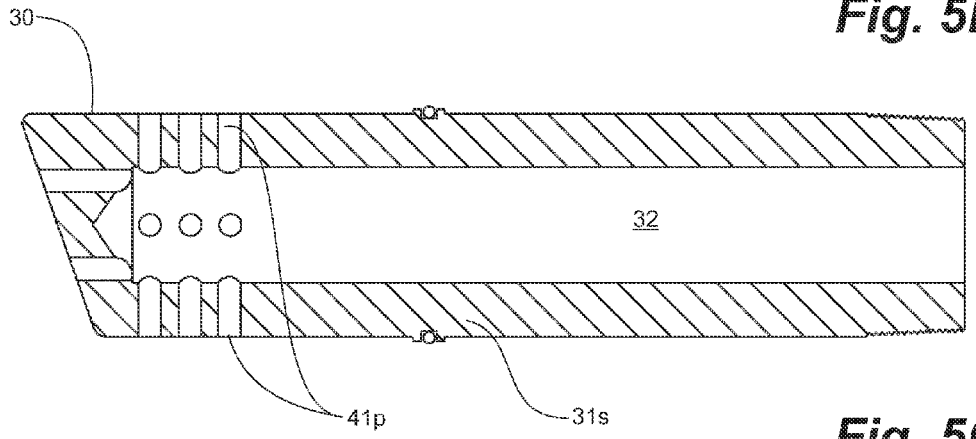

With reference to FIGS. 5A-5C, the diverter 23 can be removably fit to the catcher body, similar to a cartridge, for ease of replacing the wear components. The diverter body 31 can be one piece 31*s*, as shown in FIG. 5C, or two or more pieces 31*m*, as shown in FIGS. 5A and 5B. A two-piece body 31*m* permits the most wear prone portion, the wellhead end 30, being separable from the tail end 33. The wellhead end 30 could be manufactured of wear resistant material. Alternatively, the flow passageways 41 are wear resistant, being coated with wear resistant material or be manufactured using replaceable, hardened orifices (not shown). The wellhead end 30 comprises the diverter face 34 and the flow passages 41 for conducting fluid flow F to the bore 32. The wellhead end 30 of a two-piece diverter body 31*m* has a threaded pin portion 42 and fluid seal 43 for sealing to a box end 44 of the tail end 33. The tail end 33 has a second fluid seal, such as the O-ring 29, for sealing to the catcher body 21.

As shown in FIG. 4, the diverter body 31 can be cylindrical for insertion into the catcher flow outlet 24 and secured or retained therein by quick connection such as a coupling 50 and hammer nut 51. The diverter can also be retained using a flanged or similar connection (not shown). The coupling 50 can be threadably engaged with the diverter's tail end 33. Replacement of the diverter can be effected by equalizing fluid pressure in the catcher body 21, releasing the hammer nut 51 and replacing the entire diverter body 31 or replacing a worn wellhead end 30 of a two piece diverter body 31*m*.

The flow passages 41 can be radial flow passages 41 or extend substantially in-line with the flow path 13. As shown in FIGS. 5A-5C and 5E, some flow passages 41 though the wellhead end 30 can be radial, extending to the bore 32. Further, the flow passages 41 can be oriented radially and opposingly positioned to neutralize fluid energy as the fluid flow F enters the diverter bore 32. The plurality of flow passages can be arranged in pairs of opposing flow passages 41*p* for directing fluid flow F to impinge each other within the bore 32 and dissipate energy to minimize erosion.

Figure 5D:
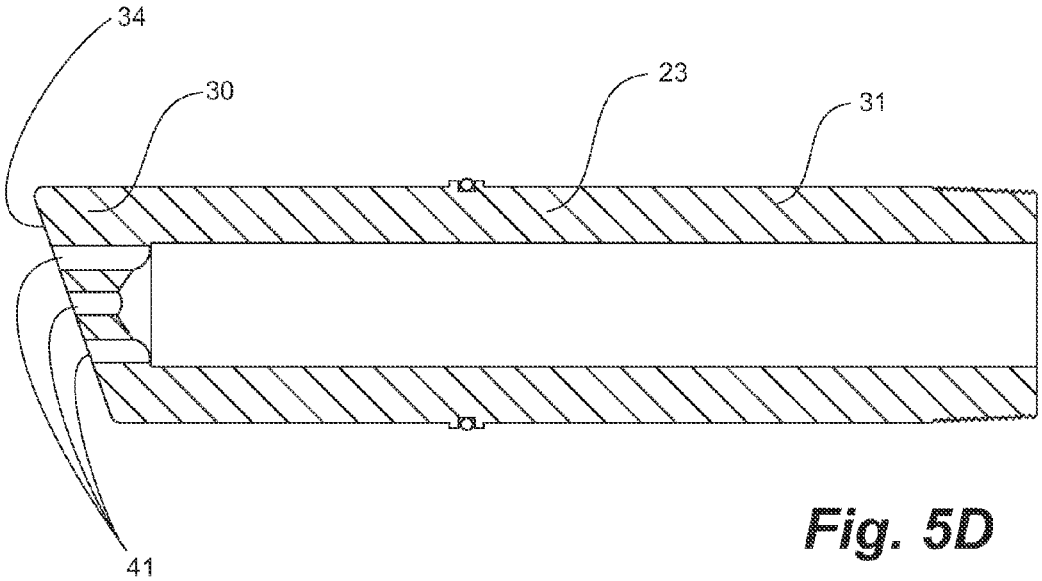
Figure 5E:
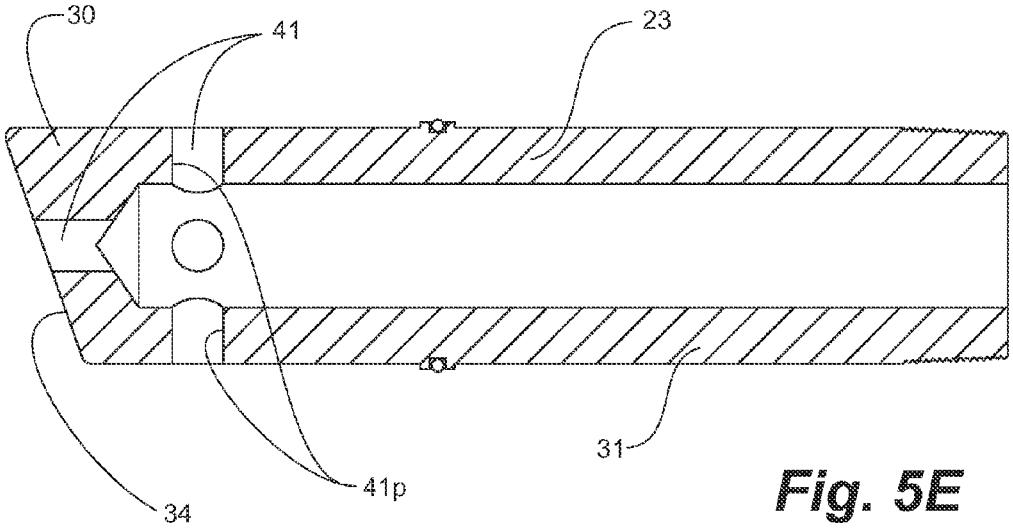

The flow passages 41 in the diverter are sized to pass the fluid flow F and can be oversized to accommodate accumulative loss due to plugging. Further, the fluid passages can be sized to be large (FIGS. 5B, 5C and 5E) for passing a range of particulates to the downstream equipment. In another embodiment, the fluid passages can be small (FIGS. 5A and 5D) for blocking the passage of large particulates for the protection of the downstream equipment, the large particulates being collected instead in the ball-recovery chamber 22. A plurality of small flow passages 41, such as those shown in FIG. 5A, can act as screen to reject undesirable particulates. Similarly, a cylindrical screen could be fit over larger flow ports.

For example, with reference to the embodiment of FIG. 4, eight flow passages 41 arranged in four pairs 41*p*, positioned at quadrants, at ⅛" diameter each can pass 5-7 m3 (per hour) of fluid (such as water or lighter hydrocarbons). Eight flow ports at 5/32" diameter can (each) pass 9-11 $m^3$ /hour and ¼" ports can (each) pass 20-25 $m^3$ (per hour). The greater the number of flow passages passing the return fluid, the less the erosion, thus increasing the life and efficiency of the diverter or diverter cartridge.

Figure 6:
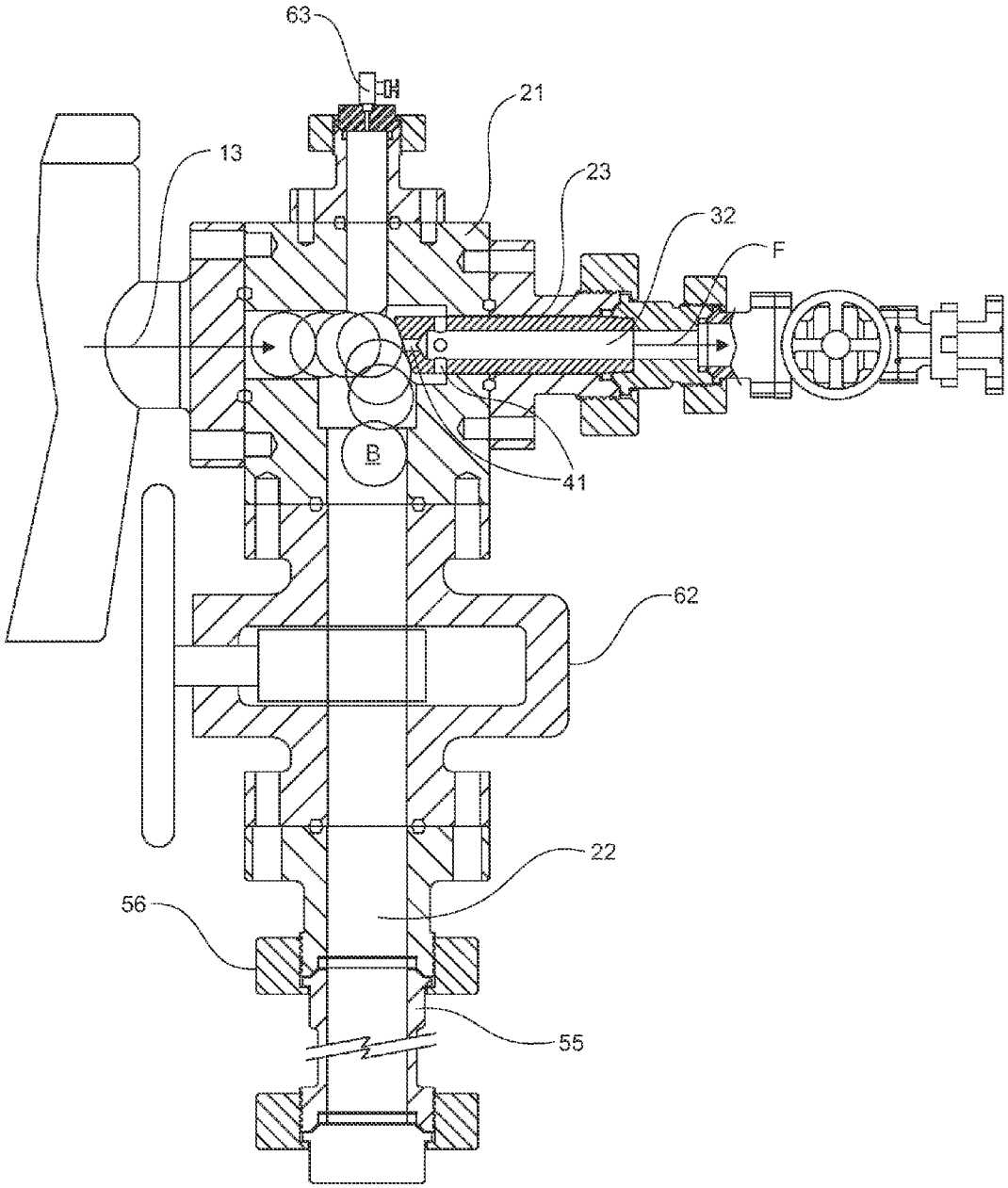
FIG. 6 is a cross-section of an alternate embodiment of a ball catcher body and illustrating a diverter accordingly to FIG. 5E.

With reference to FIG. 6, in another embodiment, the diverter 23 can further comprise in-line flow ports through the diverter face 34 and oriented into the fluid path 13. The in-line flow passages are smaller in diameter than are the solids or balls B being rejected and collected in the ball-recovery chamber 22.

Operation

As shown in the embodiments shown in FIG. 2, upon establishing fluid flow F from the wellbore, balls B (and other debris) engage the diverter face 34 and are collected in the ball-recovery chamber 22. Fluid flow F continues downstream, passes through the diverter's flow passages and is discharged through the diverter's tail end 33 to other equipment as is the usual practice in the industry.

Periodically, the wellhead 10 is shut in and a bleed valve 60 such as positioned atop the catcher body 21, is vented to equalize pressure therein and the ball-recovery chamber 22 can be emptied of debris and balls B. The diverter 23 can be quickly inspected and replaced as necessary, therefore decreasing the down time in flow back procedures. The ball-recovery reservoir can further comprise a pup joint 55 coupled releaseably to the ball-recovery chamber 22 using quick connect couplings 56. In another embodiment the wellhead 10 can be isolated from a catcher body 21 and fluid from the downstream equipment can be backflowed through the diverter 23 and ball-recovery chamber 22 for cleaning.

Figure 7:
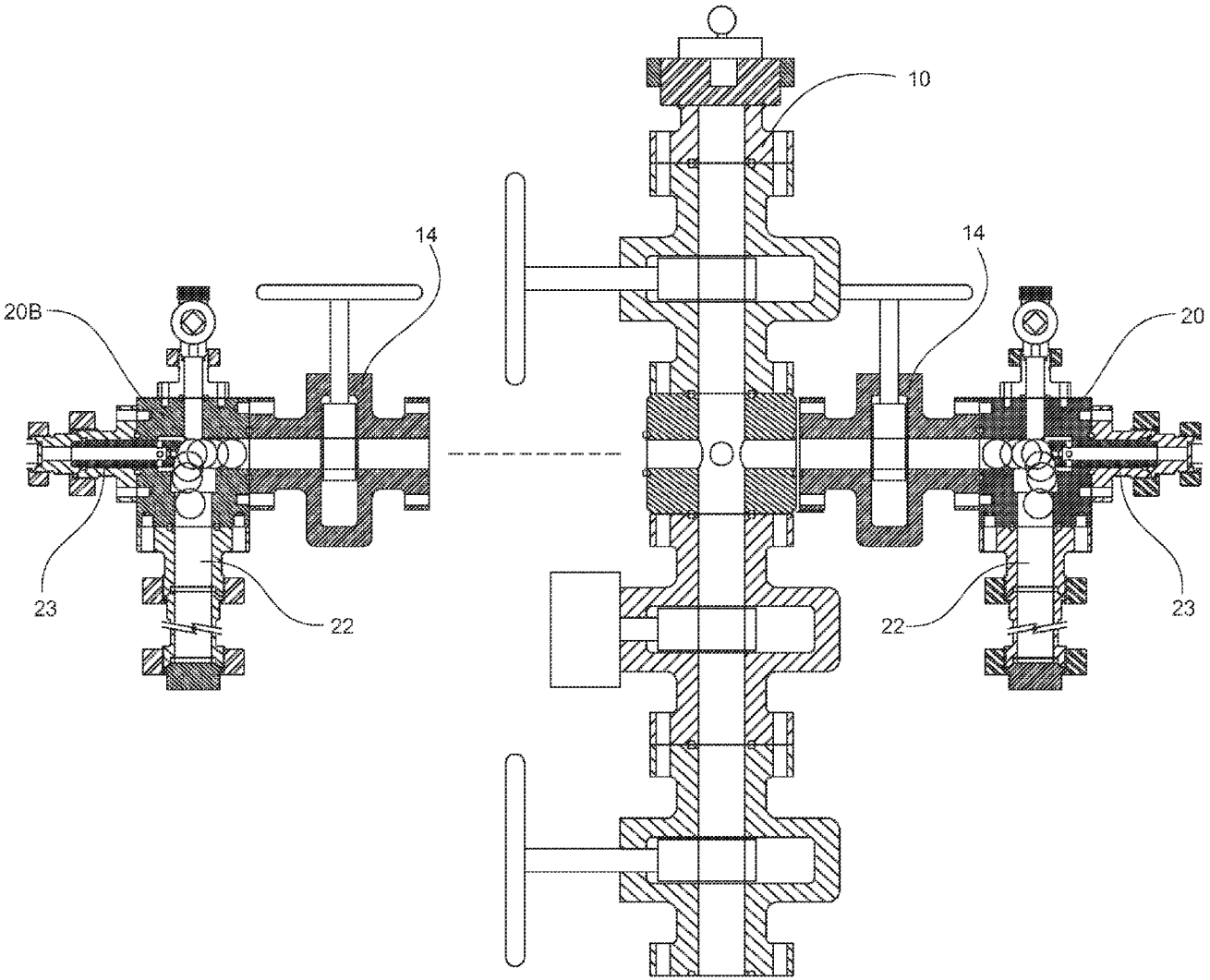
FIG. 7 is a cross-sectional view of a wellhead of conventional configuration fit with a first ball catcher and showing a second ball catcher for connection to the wellhead according to another embodiment of the invention.

With reference to FIG. 7, a second ball catcher 20B, or more depending upon the wellhead, can be fit to the wellhead 10 of FIG. 1, also with isolation valving 14, 14 between the wellhead 10 and each of the ball catchers 20, 20B. Accordingly, the first ball catcher 20 can be serviced, for replacement of the diverter 23 or inspection and cleaning of the chamber 22, while the second ball catcher 20B is in operation. In this way, wellhead flow is not interrupted. In some wellbores, even a temporary interruption can result in an unfavorable loss of suspended materials which are being elutriated from the wellbore with the fluid flow. Accordingly, redundant ball catchers 20, 20B are affixed to two or more flow paths 13 from the wellhead so that fluid flow F from the wellbore can be substantially continuous to the second ball catcher 20B while the first ball catcher 20 is taken out of service.

Undesirable sand plugs or debris plugs can occur from the fallout and or the formation may lose its upward energy and die which requires expensive coil tubing to clean the well pipe. Also flowback disruption during coil clean out, or for example bridge plug mill out, needs to be avoided because the fallout can create a sand plug and jam around the coil tubing causing further and significant expense. The second ball catcher 20B can be opened for operation, both being used temporarily, before closing in the first catcher for servicing.

In another embodiment shown in FIG. 6, an isolation valve 62 can be provided to optionally temporarily block the ball-recovery chamber 22 from the catcher body 21 for servicing. Further, a purge port 63 can be provided to introduce nitrogen to purge the ball-recovery reservoir of noxious gases such as hydrogen sulphide.

In summary, when conducting flow back operations involving wellbore fluids not having a high sand-content, an apparatus for retrieving at least balls carried within a fluid flow from a wellhead port can comprise a catcher body adapted to be fluidly connected to the wellhead port and having a flow outlet; and a diverter fit to the catcher body and having a wellhead end positioned to intercept the fluid flow from the wellhead port and to divert at least the balls carried therein into a ball recovery chamber, the diverter having a bore in fluid communication with the flow outlet and the wellhead end having flow passages formed therethrough to the bore for receiving the fluid flow free of at least the balls and discharging the fluid flow from the catcher body, wherein an annular chamber is formed between the catcher body and the wellhead end of the diverter and some of the flow passages being radial passages extending between the annular chamber and the bore, for directing at least some of the fluid flow.

The wellhead end of the diverter can have a diverter face that is angled away, such as having a concave face having an axis generally towards the ball recovery chamber, from the fluid flow for directing at least the balls into the recovery chamber.

In another embodiment, as shown by the left-hand flow F in FIG. 1 and the structures 20B, 20 set forth in FIG. 7, the ball catcher can further comprise redundant catcher bodies 20, 20B affixed to each of two or more flow paths from the wellhead 10 so that fluid flow from the wellbore can be substantially continuous to a first catcher body 20 while a second catcher body 20B is taken out of service.

Yet, in another embodiment, an apparatus for retrieving at least balls carried within a fluid flow from a wellhead port can comprise a catcher body adapted to be fluidly connected to the wellhead port and having a flow outlet; and a diverter fit to the catcher body and secured in the flow outlet with a quick connection, the diverter having a wellhead end positioned to intercept the fluid flow from the wellhead port and to divert at least the balls carried therein into a ball-recovery chamber, the diverter having a bore in fluid communication with the flow outlet and the wellhead end having flow passages formed therethrough to the bore for receiving the fluid flow free of at least the balls and discharging the fluid flow from the catcher body.

Wellbore Fluids Containing Sand

It has been found that there can be instances during flow back operations which involve wellbore fluids having sand entrained therein in sufficient quantities that can cause the sand to accumulate and compact in the ball-recovery chamber of a ball catcher. The accumulation of the sand in the ball-recovery chamber can displace or otherwise prevent returning balls from being recovered and stored therein, causing the balls to collect and jam in the ball catcher body above the sand and potentially in the wellhead itself. The jamming of the recovered balls can cause disruption of the flow of the wellbore fluids through the wellhead, ball catcher and the isolation valves associated with the ball catcher. Effects of flow disruption can result in temporary shutdown causing the well to load up, sand to fall out of the column of uprising wellbore fluid and cause sand plugs which can require expensive coil tubing cleanout. Thereafter, even after one flow resumes, the velocity of the wellbore fluid might be reduced and be insufficient to return balls. Further, continued flowback around jammed balls can lead to rapid erosion of those parts exposed to the disrupted flow of the wellbore fluids.

It has been found that the wellbore fluids in the ball-recovery chamber remain stagnant, thus permitting sand in the fluid to settle out and accumulate in the ball-recovery chamber. The accumulated sand within the ball-recovery chamber can compact upon itself, leading to the accumulated sand compacting under its own mass.

Compacted sand has been found to interfere with the normal operations of equipment such as the isolation valve. The compacted sand can be forced to enter areas for sealing and other cavities leading to premature erosion of these parts as well as possible malfunctions.

Furthermore, the process of the removing any collected balls and sand from the ball catcher involves isolating the ball catcher from the returning wellbore fluids. Such isolation procedures causes a disruption in the wellbore fluid flow which may also cause jamming and malfunctions of the ball catcher.

Figure 8:
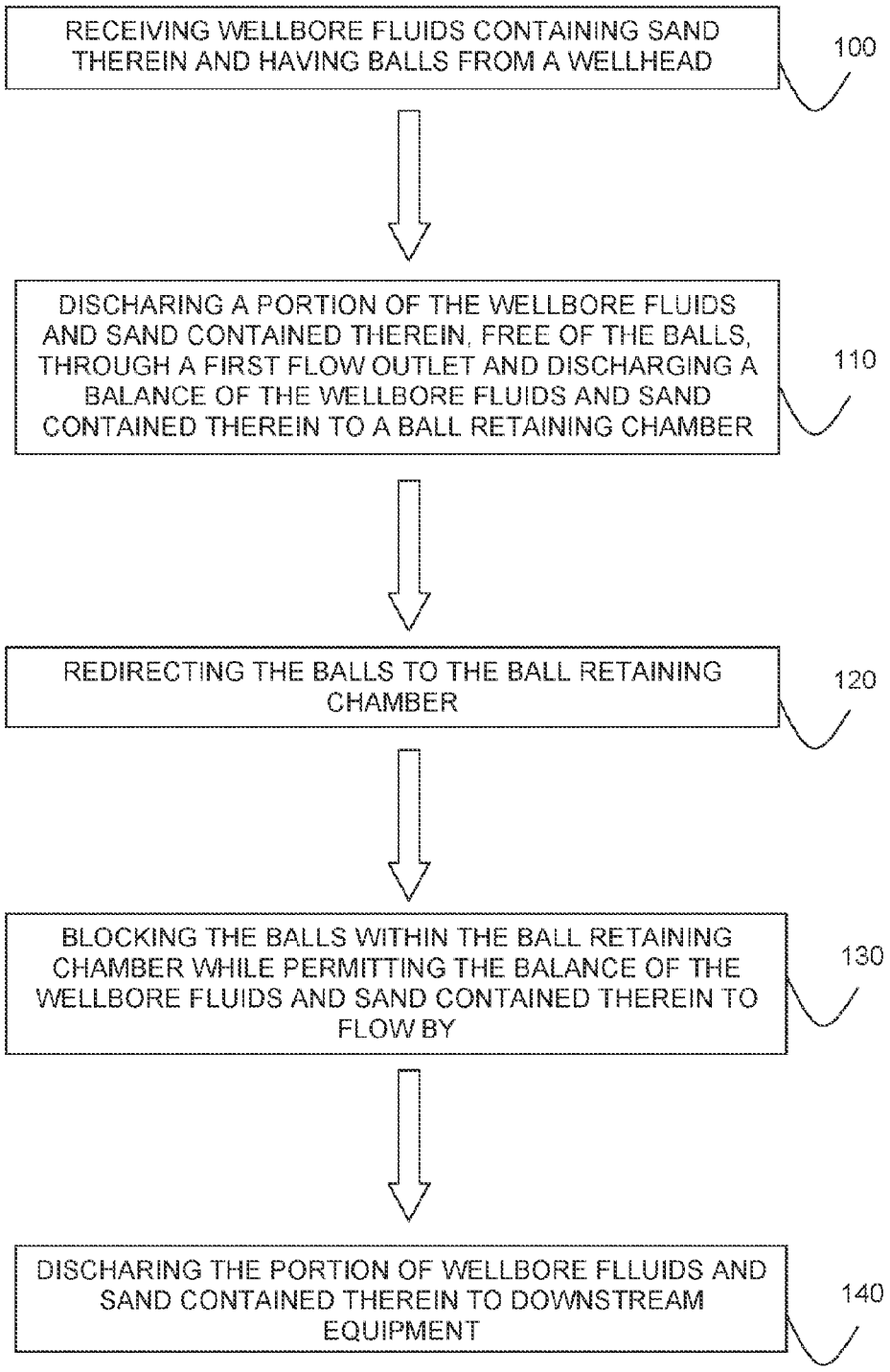
FIG. 8 is a flow chart of a process of an embodiment of the present invention.

As shown in FIG. 8, to prevent sand from accumulating and compacting within the ball-recovery chamber, wellbore fluid is directed therethrough for clearing sand which would otherwise settle therein. This is a sand-tolerant ball-retaining system which is applicable to embodiments of ball catchers disclosed herein and to other forms of ball catchers which have a wellbore fluid receiving chamber, a diverter, a ball outlet and a ball-free fluid outlet.

In an embodiment, a process for recovering balls carried in wellbore fluids containing sand can comprise the steps of receiving the wellbore fluids containing sand 100, discharging a portion of the wellbore fluids and sand contained therein through a first flow outlet and discharging a balance of the wellbore fluids and sand contained therein to a ball-retaining chamber 110, redirecting balls to the ball-retaining chamber 120, blocking the redirected balls from discharging from the ball-retaining chamber 130 and discharging the balance of the wellbore fluids and sand contained therein from a second flow outlet to downstream equipment 140.

FIG. 9 illustrates the flow F of the wellbore fluids containing sand in an embodiment of the sand-tolerant ball catcher 200. The wellbore fluids containing sand and having balls carried therein are received in a catcher body 210 which defines a receiving chamber 220 having a first flow outlet 230 for discharging a portion of the wellbore fluids and sand entrained or contained therein and a ball outlet 240 for discharging a balance of the wellbore fluids and sand contained therein. A diverter 250 is fit within the receiving chamber 220 for redirecting the balls to the ball outlet 240.

A ball-retaining chamber 260 is fluidly connected below the ball outlet 240 and receives the redirected balls and the balance of wellbore fluid and sand contained therein. A blocker 270, fit within the ball-retaining chamber 260, blocks balls from leaving therefrom while permitting the balance of the wellbore fluids and sand contained therein to flow out of the ball-retaining chamber 260. A blocker 270, can include a device similar in form to the ball diverter as disclosed in previous embodiments above, or a form of screen, any of which act to block balls from discharging with the balance of the wellbore fluid. Similarly, the diverter could be can include a device similar in form to the blocker as disclosed in embodiments below, any of which act to block and therefore divert balls from the receiving chamber.

Thus, the retaining chamber 260 retains the redirected balls within the ball-retaining chamber 260, while discharging the balance of wellbore fluids through to downstream equipment.

The constant flow of the sand-containing wellbore fluids through the receiving chamber 220, through the ball-retaining chamber 260 and to downstream equipment keeps sand suspended, preventing sand from settling out, accumulating and compacting within the ball catcher 200.

With reference to FIGS. 9 and 10, an embodiment for the sand-tolerant ball catcher 200 for recovering at balls from wellbore fluids containing sand is illustrated. The ball catcher 200 comprises a catcher body 210 defining a receiving chamber 220 for receiving the wellbore fluids, a first flow outlet 230 for discharging a portion of the wellbore fluids and sand entrained therein and a ball outlet 240 for discharging a balance of the wellbore fluids also containing sand. Fit to the catcher body 210 and within the receiving chamber 220 is a diverter 250 for diverting at least balls to the ball outlet 240. The portion of the wellbore fluids discharged through the first flow outlet 230 is directed to downstream equipment (not shown) for treatment.

Figure 14:
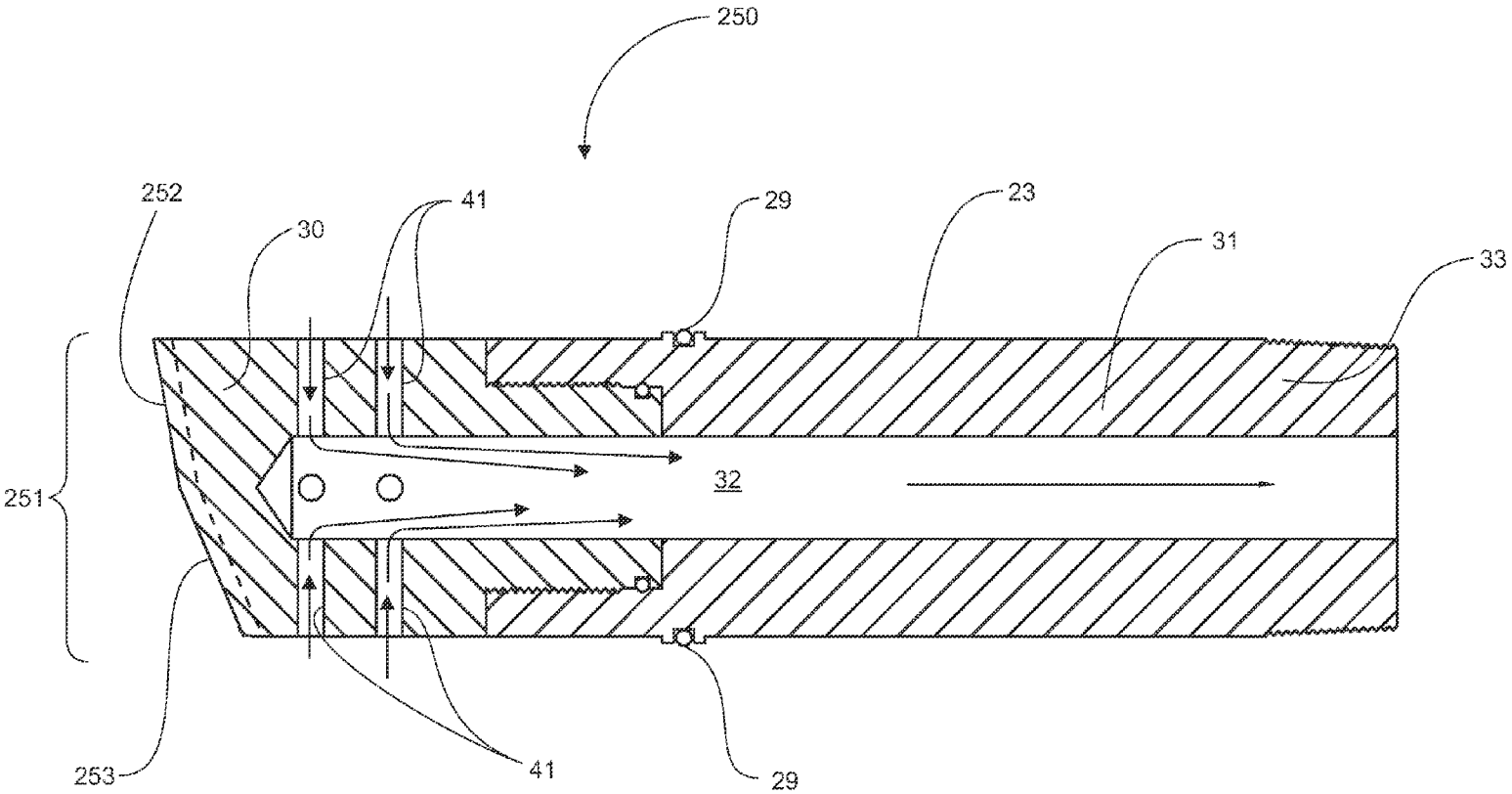
FIG. 14 is a side cross-sectional view of an embodiment of a ball diverter comprising a diverter face having a substantially vertical top face and an angled lower face.

The diverter 250 can be the diverter as disclosed above or can be any diverter known and used in the industry. As shown in FIG. 14, and in an embodiment, the diverter 250 can further comprise a diverter face 251 having a substantially vertical top face 252 and an angled lower face 253.

Figure 15:
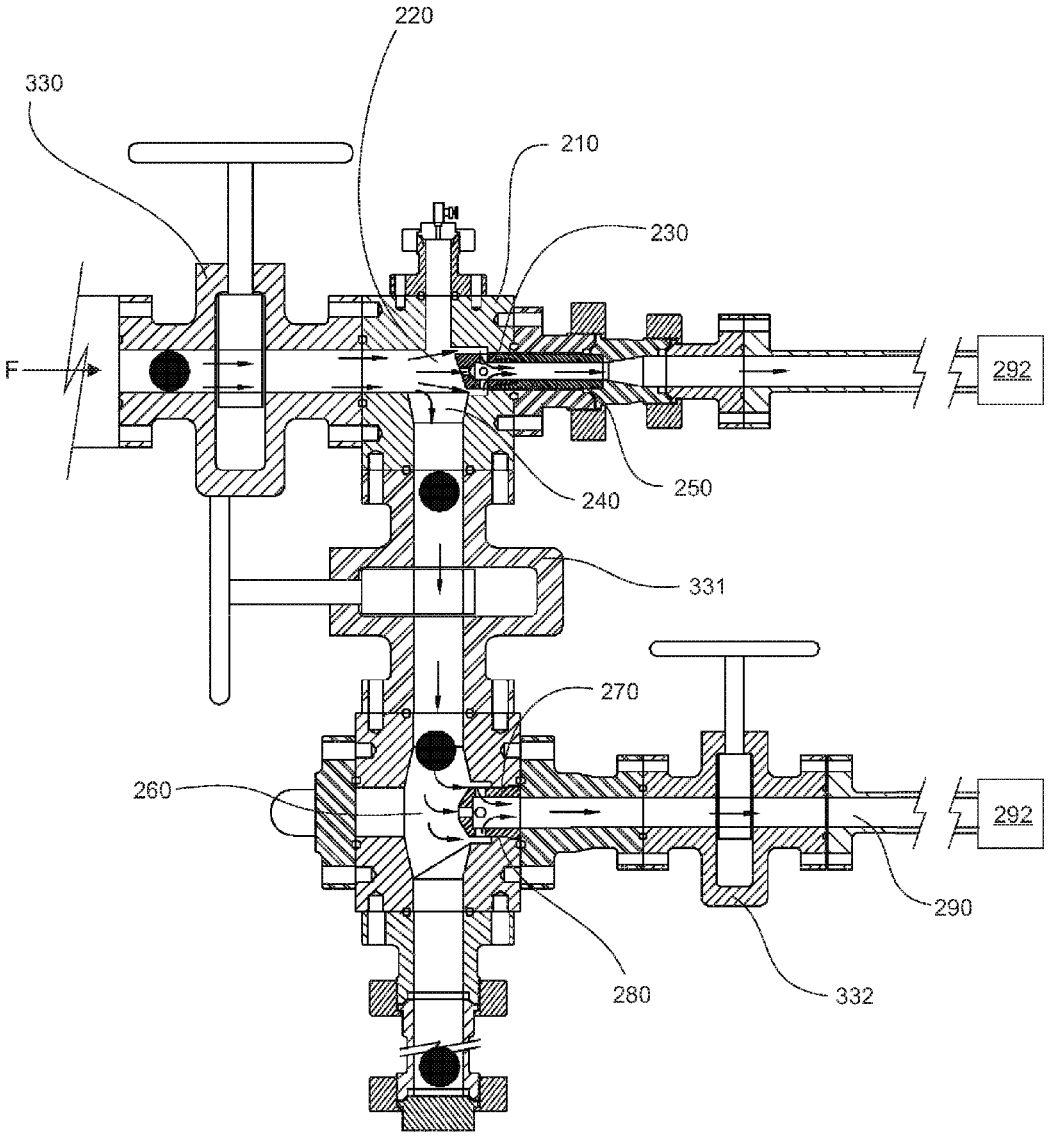
FIG. 15 is a schematic representation of an embodiment of the ball catcher of FIG. 9 wherein the flow from the first flow outlet and the auxiliary flow line are directed separately to the same downstream equipment.
Figure 16:
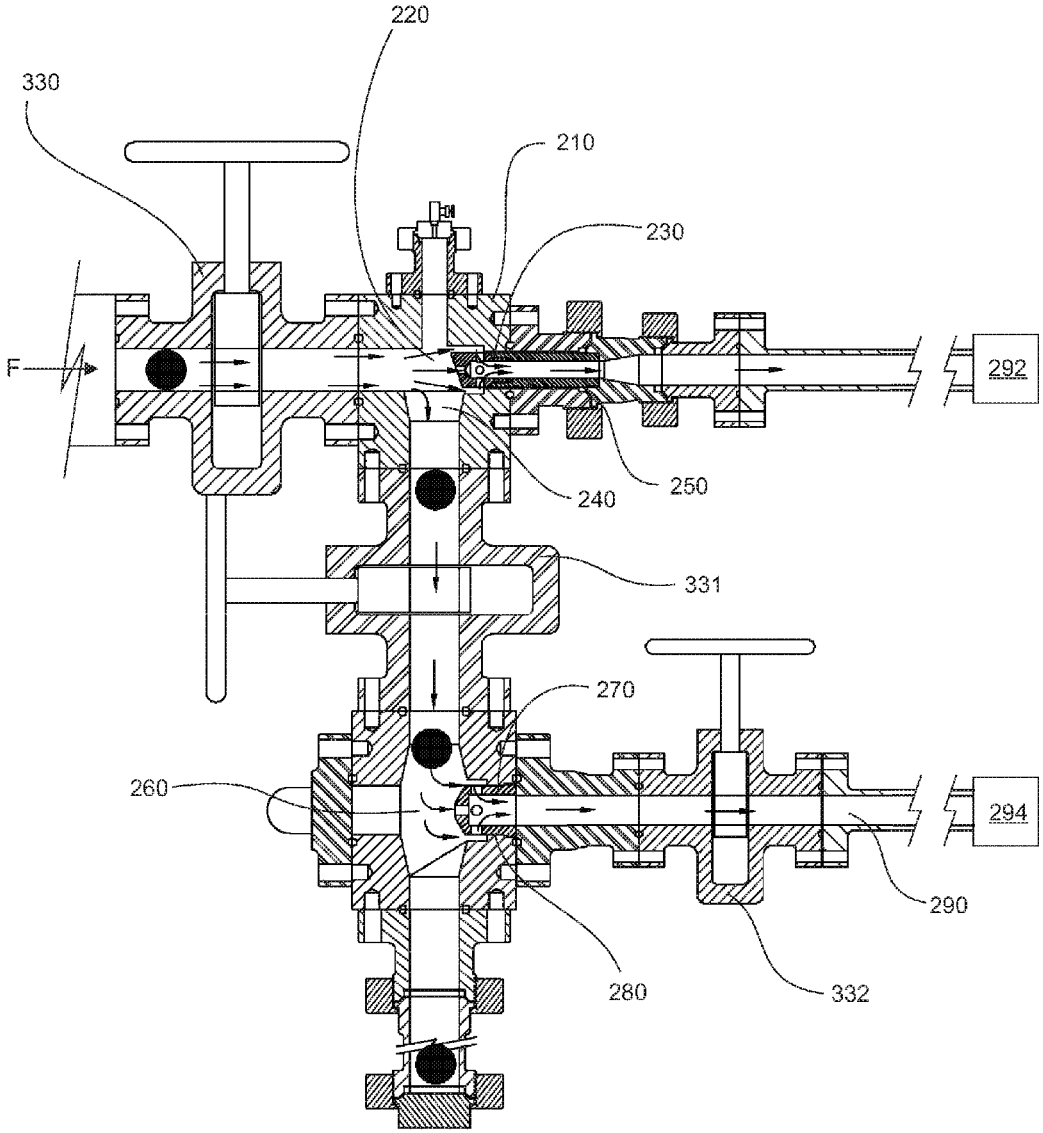
FIG. 16 is a schematic representation of an embodiment of the ball catcher of FIG. 9 wherein the flow from the first flow outlet and the auxiliary flow line are directed separately to distinct downstream equipment.

A ball-retaining chamber 260 is fluidly connected below the ball outlet 240 for receiving the redirected balls and the balance of the wellbore fluids from the receiving chamber 220. The ball-retaining chamber 260 comprises a second flow outlet 280 for discharging the balance of the wellbore fluids. An auxiliary flow line 290 is fit between the ball-retaining chamber and the downstream equipment. Fit along the auxiliary flow line 290 or, as shown in this embodiment, being fit within the second flow outlet 280, is a blocker 270 for blocking and retaining the redirected balls within the ball-retaining chamber 260 while permitting the balance of the wellbore fluids to flow therethrough and be directed to downstream equipment via the auxiliary flow line 290. In one embodiment, the auxiliary flow line 290 can be directed separately to the same 292 (see FIG. 15) or distinct downstream equipment 292, 294 (see FIG. 16), or in another embodiment as shown, the balance of the wellbore fluids and sand contained therein from the ball-retaining chamber are directed to, or to combine with the portion of the wellbore fluid from the first flow outlet.

Figure 11A:
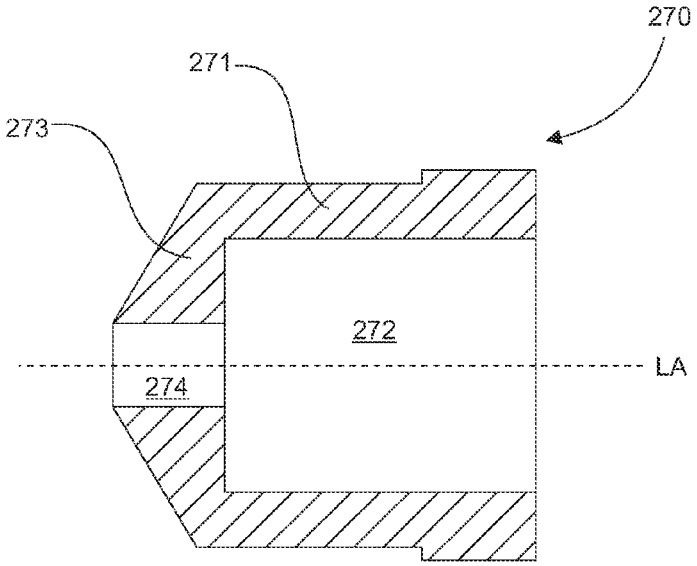
FIG. 11A is a cross-sectional view of an embodiment of the present invention illustrating a blocker having a blocker bore therethrough and a chamber end having a fluid passageway.

As shown in FIG. 11A, the blocker 270 has a blocker body 271 and a blocker bore 272 extending axially therethrough. A chamber end 273 of the body 271, for communication with or extension into the retaining chamber 260 for intercepting the flow F of the balance of wellbore fluids, has at least one fluid passageway 274 for fluidly communicating the balance of the wellbore fluids from the retaining chamber 260 into the blocker bore 272. The blocker body 271 has an open tail end 275 in fluid communication with the auxiliary flow line 290 for discharging the balance of the wellbore fluids from the ball catcher 200.

Figure 11B:
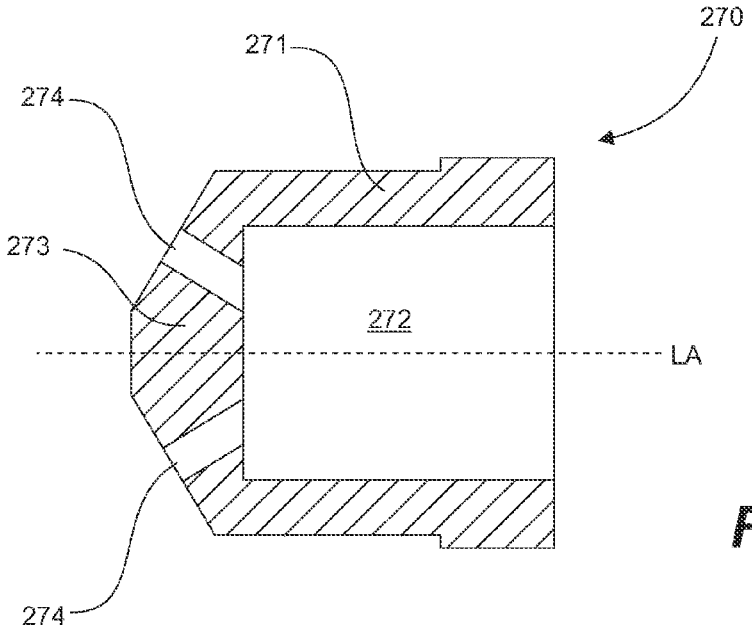
FIG. 11B is a cross-sectional view of an embodiment of the present invention illustrating a blocker having a blocker bore therethrough and a chamber end having two or more fluid passageways.

With reference to FIG. 11B, and in an embodiment, the at least one fluid passageway can comprise two or more fluid passageways for fluidly communicating the balance of the wellbore fluids from the retaining chamber 260 into the blocker bore 272. The two or more fluid passageways can be arranged to be axially angled from a longitudinal axis LA of the blocker bore 272 and arranged direct wellbore fluids from the ball-retaining to impinge each other within the locker bore 272 to dissipate fluid energy and minimize erosion of the blocker bore 272.

Figure 11C:
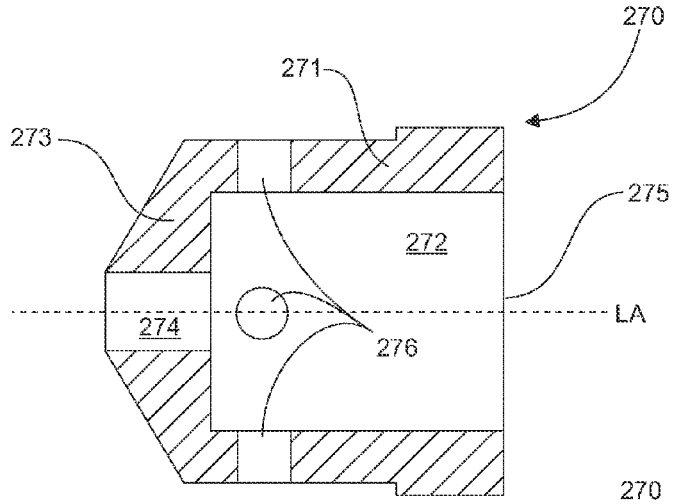
FIGS. 11C and 11D are a cross-sectional view of an embodiment of the present invention illustrating a blocker having a blocker bore therethrough and a chamber end comprising a fluid passageway and a plurality of radial passageways.
Figure 11D:
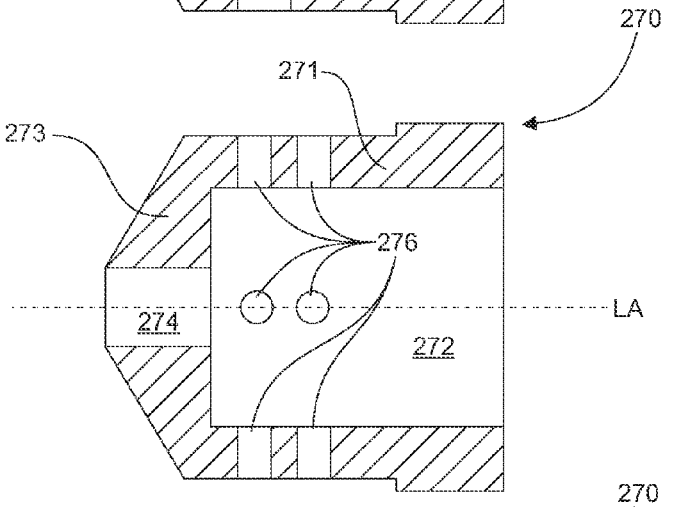

As shown in FIGS. 11C and 11D, at the chamber end 273 the fluid passageways can further comprise a plurality of radial passageways 276 circumferentially spaced about the chamber end 273 extending radially from the retaining chamber 260 to the blocker bore 272. The plurality of radial passageways 276 can be arranged to direct the wellbore fluids therefrom to impinge each other within the blocker bore 272 to dissipate fluid energy and minimize erosion. In one arrangement, the plurality of radial passageways 276 can be opposing passageways arranged in pairs to neutralize fluid energy as the wellbore fluid enters the blocker bore 272.

Figure 11E:
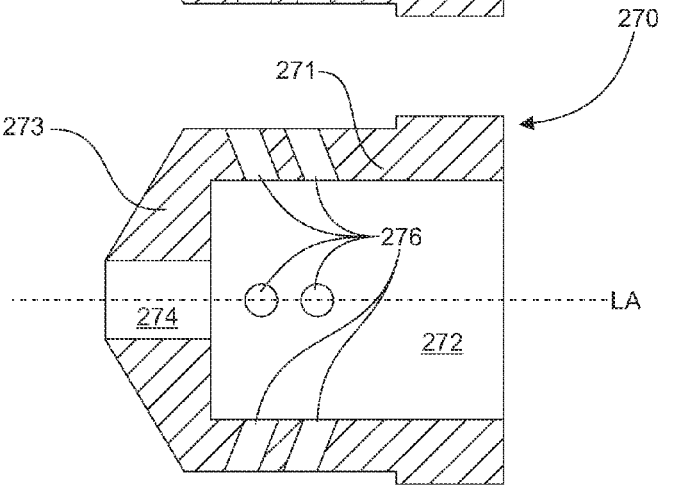
FIG. 11E is a cross-sectional view of an embodiment of the present invention illustrating a blocker having a blocker bore therethrough and a chamber end comprising a fluid passageway and a plurality of radial passageways axially angled.

As shown in FIG. 11E, and in another embodiment, the plurality of radial passageways 276 can be axially angled from the longitudinal axis LA of the blocker bore 272 to further dissipate the fluid energy imparted by the wellbore fluids flowing therethrough.

With reference to FIG. 12, the chamber end 273 of the blocker 270 extends into the retaining chamber 260 and is positioned to intercept the wellbore fluids. The chamber end 273 comprises the at least one fluid passageway 274, centrally located on the chamber end 273 and the plurality of radial passageways 276 for permitting wellbore fluids to pass therethrough. The chamber end 273 can be shaped to ensure that any redirected balls adjacent thereto will not block the at least one fluid passageway 274 nor the plurality of radial passageways 276 to disrupt the flow of the wellbore fluids through the blocker 270. In an embodiment, the chamber end 273 can be conical in shape to urge blocked balls adjacent the chamber end 273 away from the at least one fluid passageway 274 and the plurality of radial passageways 276.

Similar to the diverter body 31, the blocker body 271 can be cylindrical for removable fitment to the retaining chamber 260. It can be secured by quick connection such as a coupling and a hammer nut. The blocker body 271 can also be retained using a flange or similar connection.

In an embodiment having plurality of radial flow passages 276, the blocker 270 or the ball-retaining chamber 260 need to accommodate communication of fluid to the radial flow passages 276. Referring back to FIGS. 10 and 12, in an embodiment, and similar to the annular chamber 40 formed about the wellhead end 30 of the diverter 23, a blocker annular chamber 310 can be formed in the second flow outlet 280 about the chamber end 273 of the blocker 270. Wellbore fluids containing sand from the retaining chamber 260 flow through the blocker annular chamber 310 and inwards through the plurality of radial flow passages 276. The fluid energy of the wellbore fluids can dissipate somewhat by decreasing the wellbore fluid velocity when flowing into the blocker annular chamber 310 from the retaining chamber 260.

In an alternate embodiment, the second flow outlet 280 and the blocker 270 can be positioned below the ball-retaining chamber 260 to continuously remove and prevent sand from accumulating in the ball catcher 200. In such an embodiment, the ball-retaining chamber 260 could be reinforced with wear resistant materials as the fluid flowing around the collected balls could cause the balls to bounce around within the ball-retaining chamber 260, increasing the rate of wear on the retaining chamber 260 and the blocker 270.

In another embodiment, the blocker 270 can be manufactured from wear resistant materials or have a wear resistant coating for prolong the operational life of the blocker. The at least one fluid passageway 274 and the plurality of radial passageways 276 can be coated with a wear resistant material for prolonging the operational life of the blocker 270.

In other embodiments, the retaining chamber 260 can have two or more flow outlet ports for accessing the ball-retaining chamber 260. Each of the two or more flow outlets can be positioned either at a side of the ball-retaining chamber 260 or can be positioned at a bottom of the retaining chamber 260. The additional flow outlet ports can allow an operator to customize the ball catcher 200 to suit their particular needs. In one embodiment, an extra flow outlet can be used to access the retaining chamber 260 to remove collected balls. In another embodiment, an extra flow outlet can be used to access the retaining chamber with another redundant blocker to serve as a backup blocker and flow outlet in case the first blocker fails. Yet in another embodiment, an extra flow outlet can be used to install a valve to bleed off pressure within the retaining chamber.

In an embodiment, and as shown in FIGS. 9, 10, 12 and 13, isolation valves 330, 331, 332 can be installed between the ball catcher 200 and the wellhead (not shown), between the receiving chamber 220 and the retaining chamber 260, and between the retaining chamber 260 and the auxiliary flow line 290. The isolation valves 330, 331, 332 can be used to isolate fluid flow through either the first flow outlet in the catcher body 210 or through the auxiliary flow line 290 from the retaining chamber 260 to maintain a continual flow of wellbore fluids through of the ball catcher 200.

For example, during flow back operations, all three isolation valves 330, 331, 332 are open to allow wellbore fluids to flow into the ball catcher 200. As flow back operations continue, the retaining chamber 260 will collect balls from the balance of wellbore fluids containing sand passing therethrough, necessitating the eventual removal of the balls from the retaining chamber 260.

To remove collected balls, isolation valves 331, 332 between the receiving chamber 220 and the retaining chamber 260, and between the retaining chamber 260 and the auxiliary flow line 290 can be closed to isolate the retaining chamber 260. The closing of isolation valves 331, 332 still maintains a continual fluid flow from the wellhead (not shown), through the receiving chamber 220, through the first flow outlet 230 and to downstream equipment.

With particular reference to FIG. 12, a bleed off valve 340 can be opened to bleed off pressure within the retaining chamber 260. The collected balls can be removed safely by accessing the retaining chamber 260 through a bottom outlet port 350 on the bottom of the retaining chamber 260. During removal of the balls, the wellbore fluids containing sand continue to flow from the wellhead (not shown), through the receiving chamber 220 and out the first flow outlet 230, preventing sand from settling and accumulating in the ball catcher 200. The continual flow of wellbore fluids containing sand also prevents balls still to be recovered from jamming in the ball catcher 200 and the wellhead.

The embodiments discussed herein so far relate to a preferred embodiment of the present invention, having the blocker 270 positioned at a side of the retaining chamber 260 while reserving an outlet port at the bottom of the retaining chamber 260 for the removal of any recovered balls from the retaining chamber 260. Removal of recovered balls through the bottom outlet port 350 eases the removal operation as the recovered balls can simply drop from the retaining chamber 260 by force of gravity.

However, a person of ordinary skill in the art would understand that in an alternate embodiment, the blocker 270 can be positioned below the retaining chamber 260 and a side outlet port can be used to remove any recovered balls from the retaining chamber 260. In using such as embodiment, an operator cannot simply rely on the force of gravity to cause recovered balls to fall from the retaining chamber 260. Instead, the operator must physically remove the recovered balls from the retaining chamber 260, making the removal operation much more arduous.

In another embodiment, and as shown in FIGS. 9 and 13, a ball recovery chamber 320 is fluidly connected below the ball-retaining chamber 260 for allowing the redirected balls to be removed from the flow passage area of the ball retaining chamber 260 and collect in the ball-recovery chamber 320. In the event1 that the flow back is extremely high in sand content, sand can accumulate and compact in the ball-recovery chamber 320. However, as the level of the accumulated and compacted sand reaches the blocker 270, the at least one fluid passageway 274 and the plurality of radial passageways 276 permit a slurry of sand to continuously flow through the blocker 270 and be expelled from the ball catcher 200 through the auxiliary flow line 290. This prevents accumulated sand to compact higher than the blocker 270, preventing a jamming of the ball catcher 200 with recovered balls.

In another embodiment for accessing the ball-retaining chamber 260 for removing collected balls, and as shown in FIG. 12, the ball-retaining chamber 260 has a bleed valve 340 for bleeding off any pressure in the ball-retaining chamber 260 after isolation valves 331, 332 are closed. Once the pressure is safely bled off, one can remove collected balls and other collected debris from the ball-retaining chamber 260 and ball-recovery chamber 320. Thus, in one process for removing collected balls, one isolates the ball-retaining chamber from the receiving chamber and directing the wellbore fluids and sand contained therein to the downstream equipment, isolates the ball-retaining chamber from the downstream equipment, bleeds off any pressure from the ball-retaining chamber, and accesses the ball retaining chamber for removing balls collected therein.

The invention claimed is:

1. A ball catcher for recovering balls carried within a fluid flow of wellbore fluids returning from a wellhead, comprising:

a catcher body positioned along a flow path of fluid from the wellhead to a flow outlet, the catcher body in fluid communication with a ball recovery chamber which intersects the flow path, the balls having a first velocity vector along the flow path;

a diverter fit to the catcher body and having a wellhead end extending into the flow path, a bore being open at a tail end and in fluid communication with the flow outlet, and having a diverter face at the wellhead end, the wellhead end being positioned inline with the first velocity vector for intercepting and substantially arresting the balls and diverting at least the balls into the ball recovery chamber;

a plurality of flow passages extending through the wellhead end of the diverter to the bore for conducting the fluid flow, free of at least the balls, from about wellhead end to the bore for discharge through the tail end; and an isolation valve positioned between the catcher body and the ball recover chamber or isolating the ball recovery chamber from the flow path for servicing of the ball recovery chamber, and when so isolated the wellbore fluids continue to flow along the flow path from the wellhead to the flow outlet.

2. The ball catcher of claim 1, further comprising:

an annular chamber is formed in the flow outlet about the wellhead end of the diverter for receiving the fluid flow, at least some of the fluid continuing to flow substantially along the flow path and about the diverter face.

3. The ball catcher of claim 1, wherein the catcher body further comprises a bleed valve, and wherein when the wellhead is shut in, the bleed valve is vented to equalize pressure therein and in the ball recovery chamber.

4. The ball catcher of claim 1, wherein the ball recovery chamber further comprises:

a ball-retaining chamber for receiving the diverted balls and a portion of the wellbore fluids; and a blocker fit to the ball-retaining chamber for retaining the diverted balls within the ball-retaining chamber while permitting discharge of the portion of the wellbore fluids, free of the balls, to an auxiliary flow line.

5. The ball catcher of claim 4, wherein the isolation valve positioned between the catcher body and the ball recovery chamber is a first isolation valve, further comprising a second isolation valve positioned between the ball-retaining chamber and the auxiliary flow line, wherein the first and second isolation valves isolate the ball-retaining chamber.

6. The ball catcher of claim 5, wherein the ball-retaining chamber further comprises a bleed valve for bleeding off pressure within the isolated ball-retaining chamber.

7. A ball catcher for recovering balls carried within a fluid flow of wellbore fluids returning from a wellhead, comprising:

a catcher body adapted to be fluidly connected to the wellhead and having a flow outlet along a flow path contiguous with the fluid flow from the wellhead;

a diverter fit to the catcher body and having a wellhead end positioned to intercept the wellbore fluids from the wellhead and to divert at least the balls carried therein into a ball recovery chamber, the diverter having a bore in fluid communication with the flow outlet and the wellhead end having flow passages formed therethrough to the bore for receiving the wellbore fluids free of the balls and discharging the wellbore fluids from the catcher body through the flow outlet; and an isolation valve positioned between the catcher body and the ball recovery chamber for isolating the bail recovery chamber from the flow path for servicing of the ball recovery chamber, and when so isolated, the wellbore fluids continue to flow alone the flow path from he wellhead to the flow outlet.

8. The ball catcher of claim 7 further comprising an annular chamber formed between the catcher body and the wellhead end of the diverter and some of the flow passages being radial passages extending between the annular chamber and the bore, for directing at least some of the fluid flow.

9. The ball catcher of claim 7, wherein the catcher body further comprises a bleed valve, and wherein when the wellhead is shut in, the bleed valve is vented to equalize pressure therein and in the ball recovery chamber.

10. The ball catcher of claim 7, wherein the ball recovery chamber further comprises:

a ball-retaining chamber for receiving the diverted balls and a portion of the wellbore fluids; and a blocker fit to the ball-retaining chamber for retaining the diverted balls within the ball-retaining chamber while permitting discharge of the portion of the wellbore fluids, free of the balls, to an auxiliary flow line.

11. The ball catcher of claim 10, wherein the isolation valve positioned between the catcher body and the ball recovery chamber is a first isolation valve, further comprising a second isolation valve positioned between the ball-retaining chamber and an auxiliary flow line, wherein the first and second isolation valves isolate the ball-retaining chamber.

12. The ball catcher of claim 11, wherein the ball-retaining chamber further comprises a bleed valve for bleeding off pressure within isolated the ball-retaining chamber.

13. A process for servicing balls recovered from wellbore fluids returning from a wellhead comprising:

receiving the wellbore fluids containing the balls in a catcher body having a fluid flow outlet along a flow path contiguous with the fluids from the wellhead;

redirecting at least the balls to a ball recovery chamber;

discharging the wellbore fluids through the fluid flow outlet; and temporarily blocking the ball recovery chamber from the catcher body for servicing wherein when blocked, the wellbore fluids continue to flow along the flow path from the wellhead to the flow outlet.

* * * * *